US008366514B2

(12) United States Patent
Ide et al.

(10) Patent No.: US 8,366,514 B2
(45) Date of Patent: Feb. 5, 2013

(54) SEMICONDUCTOR SUBSTRATE PLANARIZATION APPARATUS AND PLANARIZATION METHOD

(75) Inventors: Satoru Ide, Annaka (JP); Moriyuki Kashiwa, Annaka (JP); Kazuo Kobayashi, Annaka (JP); Noriyuki Motimaru, Annaka (JP); Eiichi Yamamoto, Annaka (JP); Tomio Kubo, Annaka (JP); Hiroaki Kida, Yokohama (JP)

(73) Assignee: Okamoto Machine Tool Works, Ltd., Annaka (JP)

( * ) Notice: Subject to any disclaimer, the term of this patent is extended or adjusted under 35 U.S.C. 154(b) by 438 days.

(21) Appl. No.: 12/748,109

(22) Filed: Mar. 26, 2010

(65) Prior Publication Data

US 2011/0165823 A1 Jul. 7, 2011

(30) Foreign Application Priority Data

Jan. 7, 2010 (JP) ..... 2010-001727

(51) Int. Cl.
*B24B 1/00* (2006.01)
*B24B 5/02* (2006.01)

(52) U.S. Cl. ..... 451/41; 451/57; 451/65; 451/5; 451/287

(58) Field of Classification Search ..... 451/41, 451/57–59, 65, 5, 11, 285–289, 340, 259
See application file for complete search history.

(56) References Cited

U.S. PATENT DOCUMENTS

| | | | | |
|---|---|---|---|---|
| 6,042,455 | A * | 3/2000 | Togawa et al. | 451/8 |
| 6,354,922 | B1 * | 3/2002 | Sakurai et al. | 451/67 |
| 6,431,964 | B1 | 8/2002 | Ishikawa et al. | |
| 6,629,883 | B2 * | 10/2003 | Katsuoka et al. | 451/332 |
| 6,682,408 | B2 * | 1/2004 | Sakurai et al. | 451/67 |
| 6,878,044 | B2 * | 4/2005 | Sakurai et al. | 451/67 |
| 6,916,231 | B2 * | 7/2005 | Wakabayashi | 451/66 |
| 7,234,999 | B2 * | 6/2007 | Sakurai et al. | 451/5 |
| 7,238,087 | B1 | 7/2007 | Kashiwa et al. | |

FOREIGN PATENT DOCUMENTS

| | | |
|---|---|---|
| JP | 2001-252853 | 9/2001 |
| JP | 2002-219646 | 8/2002 |
| JP | 2005-098773 | 4/2005 |
| JP | 2007-165802 | 6/2007 |
| JP | 4260251 | 2/2009 |
| JP | 2009-088073 | 4/2009 |
| JP | 2010-23119 | 2/2010 |

* cited by examiner

*Primary Examiner* — Dung Van Nguyen
(74) *Attorney, Agent, or Firm* — Oblon, Spivak, McClelland, Maier & Neustadt, L.L.P.

(57) ABSTRACT

A planarization apparatus and method that thins and planarizes a substrate by grinding and polishing the rear surface of the substrate with high throughput, and that fabricates a semiconductor substrate with reduced adhered contaminants. A planarization apparatus that houses various mechanism elements in semiconductor substrate loading/unloading stage chamber, a rear-surface polishing stage chamber, and a rear-surface grinding stage chamber. The throughput time of the rear-surface polishing stage that simultaneously polishes two substrates is typically about double the throughput time of the rear-surface grinding stage that grinds one substrate.

16 Claims, 4 Drawing Sheets

SEMICONDUCTOR SUBSTRATE PLANARIZATION APPARATUS AND PLANARIZATION METHOD

BACKGROUND OF THE INVENTION

The present application claims priority to Japanese Patent Application No. 2010-1727 filed on Jan. 7, 2010. The entire content of Japanese Patent Application No. 2010-1727 is hereby incorporated herein by reference.

FIELD OF THE INVENTION

One example of the present invention relates to a semiconductor substrate planarization method and planarization apparatus that is used to thin and planarize a substrate by grinding and polishing the rear surface of a semiconductor substrate, such as a sapphire substrate, a 3D-TSV wafer (through-silicon-vias wafer), an SOI (silicon-on-insulator) wafer, and a next-generation DRAM having a diameter of 300 to 450 mm, at the IC substrate processing step. One aspect of the present invention relates to a semiconductor substrate planarization apparatus and planarization method that enables processing without or with reduced breakage or chipping of the semiconductor substrate, either during the process that thins and planarizes the DRAM silicon substrate layer to a thickness of 20 to 70 μm, or when thinning and planarizing a substrate on the upper side of a lamination substrate such as a TSV wafer, SOI wafer, etc.

DESCRIPTION OF THE RELATED ART

As a planarization apparatus that grinds and polishes a semiconductor substrate to a thin and mirror-polish, a planarization apparatus has been implemented including a planarization apparatus equipped with a substrate loading/unloading stage, a substrate grinding stage, a substrate polishing stage, and a substrate cleaning stage installed in a chamber. A substrate load port's substrate storage cassette is provided outside the chamber. These planarization apparatuses have the ability to perform planarization that thins a thickness of about 750 μm of a semiconductor substrate with a diameter of 300 mm, at a throughput of 7-20 wafers/hour.

For example, Japanese Published Unexamined Application No. 2001-252853 (Patent Document 1) describes a planarization apparatus comprising: a grinding means that grinds a wafer; a polishing means that polishes the ground wafer with the grinding means; a wafer holding member formed with a diameter smaller than that of the aforementioned wafer; a chamfering means having a grinding wheel for chamfering, which chamfers the periphery of a wafer held in said wafer holding member; and a transfer means that transfers the wafer to the aforementioned grinding means, after chamfer processing by said chamfering means or a transfer means that transfers the wafer to the wafer holding member of the aforementioned chamfering means, after polishing by the aforementioned polishing means. Patent Document 1 also describes a method of housing in a cassette a wafer subjected to a planarization process such that a ground and polished wafer is loaded onto the stage of the chamfering means, after which the grinding wheel for chamfering is used to chamfer the sharp edge portions of a polished wafer, and then this planarized wafer is stored in the cassette.

Japanese Published Unexamined Application No. 2005-98773 (Patent Document 2) describes a planarization apparatus such that: four sets of substrate holder tables (vacuum chucks) are installed in the same indexed rotary table; one of these substrate holder tables is regarded as the substrate loading/unloading stage, and above the remaining three substrate holder tables are arranged, respectively, a rotary spindle equipped with a rough-grinding cup wheel-type diamond grinder, a rotary spindle equipped with a finish-grinding cup wheel-type diamond grinder, and a rotary spindle equipped with a dry-polish flat grinder.

In addition, the specification of U.S. Pat. No. 7,238,087 (Patent Document 3) describes a substrate planarization apparatus 10 shown in FIG. 4. This planarization apparatus 10 is equipped with a plurality of substrate storage stages (load port) 13 outside of the chamber. Inside the chamber is a substrate planarization apparatus comprising: an articulated substrate transfer robot 14 on a base 11; a temporary positioning placement table 15; a movable transfer pad 16; a grinding stage 20 in which the substrate holders 30*a*, 30*b*, 30*c* of a member forming three stages (i.e., substrate loading/unloading stage S1, rough-grinding stage S2, finish-grinding stage S3) are disposed in concentric circles on first indexed rotary table 2; and a polishing stage 70 in which a substrate holder table 70*a* forming a substrate loading/unloading stage/finish-polishing stage PS1 and a substrate holder table 70*b* forming a rough polishing stage PS2 are disposed in concentric circles on a second indexed rotary table 71.

Japanese Patent No. 4,260,251 (Patent Document 4) proposes a wafer polishing apparatus comprising: a base such that a plurality (where n is an integer from 2 to 4) of polishing plates are arranged on the same circumference; an index head that supports, above this base, a plurality (n+1 sets) of chuck mechanisms, in free rotation, and on a rotary shaft; and a wafer pedestal on which are placed unpolished wafers transported from a cassette and polished wafer transported by a chuck mechanism. In the wafer polishing apparatus, which uses a chuck mechanism to hold the rear surface of a wafer and pushes its surface against a polishing plate, where the wafer surface is polished, the circumference that connects the center lines of the rotary shafts of the aforementioned plurality of sets of chuck mechanisms is on the aforementioned circumference. The aforementioned pedestal is formed by integrally arranging in a straight line wafer support plates and rotary brushes for chuck mechanism cleaning. The pedestals in which a support plate and rotary brush are provided in proximity are provided so as to be able to freely advance or retreat in a straight line. The vertical plane in the direction of the straight line in which the pedestal advances or retreats is below the aforementioned index head. The aforementioned pedestals are provided so as to enable free advancement or retreat in a straight line, so as to intersect the aforementioned circumference.

Furthermore, Unexamined Japanese Application Publication No. 2002-219646 (Patent Document 5) describes a substrate polishing apparatus comprising: a substrate chuck mechanism in which four sets of spindles provided with equal spacing on the same circumference, centered on a rotary shaft, are installed in an index head borne above, on said rotary shaft; a rotation mechanism that rotates the rotary shaft of the aforementioned index head, in the clockwise direction, in increments of 90°, 90°, 90°, and 90°, or in increments of 90°, 90°, 90°, and −270°. The polishing apparatus describes an elevator mechanism that raises and lowers the spindles of the aforementioned substrate chuck mechanism. The apparatus also includes a mechanism that rotates the spindles in the horizontal direction; a substrate loading/substrate unloading/chuck cleaning stage, first polishing stage, second polishing stage, and third polishing stage, which are provided with equal spacing on the same circumference from the center coinciding with the center of the rotary shaft of the aforementioned index head, so as to oppose, below the aforementioned four sets of substrate chuck mechanism. The apparatus includes an index table such that a first substrate loading/unloading stage, a substrate chuck mechanism cleaning stage, and a second substrate loading/unloading stage are provided thereupon, with equal spacing and on the same circumference. However, these three stages are moved by the rotation of the index table, forming the aforementioned substrate loading/substrate unloading/chuck cleaning stage. A rotation mechanism rotates the aforementioned index table, in the clockwise direction, in increments of 120°, 120°, and 120°, or in increments of 120°, 120°, and −240°. The apparatus includes a substrate feed mechanism comprising a substrate loading cassette and a substrate loading transfer robot, which are provided in front of, and to the left and right of, the aforementioned index table; and a substrate discharge mechanism comprising a substrate unloading cassette and a substrate unloading transfer robot.

Unexamined Japanese Application Publication No. 2007-165802 (Patent Document 6) proposes a substrate planarization apparatus that holds, grinds, and polishes substrates on four sets of adsorption tables provided on an indexed turntable, with their rear surfaces upward The apparatus includes a rotary blade (cutting means) that performs processing that grinds the outer edge, from the rear surface to the front surface, at the outer edge of the aforementioned pre-grinding substrate, which is adsorbed onto the aforementioned adsorption table.

The apparatus further includes two sets of grinding wheels (grinding means) that are equipped with grinding wheels disposed in opposition to the aforementioned adsorption table, and that, while holding the aforementioned substrate whose outer edge is ground on the aforementioned adsorption table, grind by pressing the rear surface of the aforementioned substrate, while rotating the aforementioned grinding wheels.

The apparatus further includes a polishing puff (polishing means) that is equipped with a polishing puff (polishing pad) disposed in opposition to the aforementioned adsorption table, and that polishes by pressing the rear surface of the aforementioned substrate, while holding the previously described ground substrate on the aforementioned adsorption table and rotating the aforementioned polishing puff.

These planarization apparatus are installed in a chamber, and a plurality of load ports (substrate storage cassette) are provided outside the chamber.

The chamber behind the aforementioned load ports is equipped with a two-jointed link-type substrate transport robot, a temporary positioning placement table, and a wet scrubber.

The aforementioned cutting means (rotary blade) of this planarization apparatus has the following effect. In the planarization apparatus of Patent Document 1, the substrate chips readily during grinding and substrate transport, and the processed substrate has a high loss rate, so this rotary blade cuts away the entire outer edge of the aforementioned substrate, thereby inhibiting breakage of the semiconductor substrate and chipping of the substrate periphery.

Semiconductor substrate processors are demanding the thinning to 20-50 μm of the approximately 770-μm silicon substrate layer of the semiconductor substrate, whose next generation will have a diameter of 300 mm, and whose generation after that will have a diameter of 450 mm. It is desireable to have a planarization apparatus that, as a substrate planarization apparatus, is compact (i.e., has a small footprint), is capable of a 20-25/hour throughput of 300-mm diameter semiconductor substrates, and is capable of a 7-12/hour throughput of 450-mm diameter semiconductor substrates. In addition, it is desireable to have a planarization apparatus capable of a 10-15/hour throughput of ground and polished TSV wafers, in which the electrode head projection height of a 300-mm diameter TSV wafer is 0.5-20 μm.

It has been pointed out by semiconductor substrate processors that, although there is no problem when obtaining a semiconductor substrate with a silicon substrate thickness of at least 80 μm, when obtaining a semiconductor substrate with a silicon substrate thickness of 20-50 μm, chipping or breakage occurs in the semiconductor substrate, so it is often necessary to provide a semiconductor substrate edge grinding stage such as that described in the aforementioned Patent Document 1 and Patent Document 6.

In the planarization apparatus described in Patent Document 1 and Patent Document 6, a semiconductor substrate is subjected to edge grinding and rear surface polishing. Therefore, a defect may exist inasmuch as the polishing stage portion is often readily contaminated by grinding swarf generated at the grinding stage. The presence of this grinding swarf often becomes a fatal defect, particularly when the planarization apparatus polishing stage is used for the electrode head projections (height: 1-20 μm) of a TSV wafer (through-electrode wafer).

Furthermore, for the Patent Document 6's edge portion cutting rotary blade and the commercially available polishing tape edge portion chamfering device, it is difficult to chamfer the edge portion (including bevel portion) of the lamination bonding section of a wafer, such as a TSV wafer, SOI wafer, etc. In addition, the protective tape that protects the wiring print surface of the semiconductor substrate delaminates at the silicon substrate edge portion, and the grinding swarf and polishing swarf readily adhere to the silicon substrate edge periphery.

Furthermore, for the fabrication of next-generation, 450-mm diameter semiconductor substrates, the planarized area is enlarged to as much as 2.25× that of a semiconductor substrate with a 300-mm diameter. Therefore, high throughput cannot be achieved simply by enlarging the dimensions of the semiconductor substrate planarization apparatus described in the group of patent documents of the aforementioned prior art.

One example of the present invention aims at providing a semiconductor substrate planarization apparatus that, at the stage at which the planarization apparatus polishes a semiconductor substrate, which was described in Patent Document 3, improves the semiconductor substrate polishing time at the polishing stage (i.e., the throughput) by replacing the two chuck polishing heads described in described in Patent Documents 4 and 5 with four sets of indexed turn heads; and replaces the rotary blade of the edge portion cutting means described in Patent Document 6 with a grinding wheel, thereby enabling partial chamfering of the edge portion of the laminated wafer.

SUMMARY OF THE INVENTION

One example of the invention provides a semiconductor substrate planarization apparatus in which a chamber in which a planarization apparatus is set up is partitioned, from the front portion, by partitions into three chambers: an L-shaped semiconductor substrate loading/unloading stage chamber, a middle semiconductor substrate polishing stage chamber, and a rear-portion semiconductor substrate grinding stage chamber. This example of the invention includes an opening portion that opens to an adjacent-stage chamber and enables the insertion and extraction of a substrate provided in the partition between each of the stage chambers. Substrate storage cassettes for a plurality of load ports are provided outside the front wall chamber of the loading/unloading stage chamber.

In a semiconductor substrate loading/unloading stage chamber are provided a first articulated substrate transfer robot in the chamber behind the loading port, a substrate wet scrubber is provided to its left. A first temporary positioning placement table is provided above the substrate wet scrubber, and a second transport-type articulated substrate transfer robot is provided far behind the first temporary positioning placement table.

In the polishing stage chamber are provided a polishing means such that the centers of four sets of stages are on the same circumference. The sets include both a temporary placement table stage on which four sets of circular temporary placement tables large enough to accommodate four substrates are provided on the same circumference and with equal spacing, and three sets of planar and circular first, second, and third polishing stages that simultaneously polish two substrates.

Also in the polishing stage chamber are provided a polishing means installed in free rotation, with equal spacing, and three sets of dressers that dress a polishing stage abrasive cloth on the side of each of the three sets of polishing stages. One index head is provided above these four sets of stages. Below the index head is provided a polishing stage such that a substrate chuck capable of adsorbing and immobilizing eight substrates, in which chuck are provided in a concentric circle four sets of substrate adsorption chuck mechanisms that use the main shaft to support, simultaneously, independently, and in free rotation, a pair of substrate adsorption chucks that adsorb downward the surfaces of substrates to be polished. This arrangement enables the opposition of each semiconductor substrate adsorbed onto each substrate adsorption chuck in accordance with each of the four sets of stages.

In the semiconductor substrate grinding stage chamber, a second temporary positioning placement table is provided behind the second transport-type articulated substrate transfer robot; a hand arm two-sided rotary-type third articulated transfer robot is provided to the right of the second temporary positioning placement table. A substrate front-/rear-surface wet scrubber is provided to the right of the third articulated transfer robot. Behind the third articulated transfer robot and the substrate front-/rear-surface wet scrubber are provided a substrate chuck stage in which four sets of substrate chuck tables are provided, on the same circumference, with equal spacing, and in free rotation, on one indexed turntable. The positions of the loading/unloading stage chuck, substrate rough-grinding stage chuck, substrate edge grinding stage chuck, and substrate finish-grinding chuck of the four sets of substrate chuck tables are indexed and stored in a numerical control device. An edge grinder that than allows the edge grinding wheel to move back and forth and to rise and fall up and down is provided beside the substrate edge grinding stage chuck. A cup wheel-type rough-grinding wheel is provided above the substrate rough-grinding stage chuck, so as to allow vertical ascending and descending and rotation. A cup wheel-type finish-grinding wheel is provided above the substrate finish-grinding stage chuck, so as to allow vertical ascending and descending and rotation.

A provided grinding stage chamber performs the following operation: the third articulated transfer robot transports the semiconductor substrate on the second temporary positioning placement table onto the loading/unloading stage chuck, transports the semiconductor substrate on the loading/unloading stage chuck onto the substrate front-/rear-surface wet scrubber, and transports the semiconductor substrate on the substrate front-/rear-surface wet scrubber onto the temporary placement table stage in the polishing stage chamber.

A further example of the invention provides a method of planarizing the rear surface of a semiconductor substrate. The semiconductor substrate planarization apparatus described in the previous example is used to transport into the grinding stage chamber the semiconductor substrates stored in a substrate storage cassette.

In the grinding stage chamber, a cup wheel grinder is used to roughly grind the rear surface of a semiconductor substrate. A width of 1 to 3 mm is removed from the rear surface peripheral edge of the roughly ground semiconductor substrate, by edge-grinding with a grinding wheel, after which the rear surface of the semiconductor substrate is thinned by using a cup wheel grinder for finish-grinding.

The thinned semiconductor substrate is transported to a polishing stage chamber.

In the polishing stage chamber, the rear surface of the semiconductor substrate is planarized by performing rough-polishing, medium-finish polishing, and finish-polishing, which subject to sliding friction, at the polishing stage, the rear surfaces of the two thinned semiconductor substrates held by a pair of adsorption chucks.

By providing edge grinding that uses an edge grinding wheel to reduce the thickness of the edge portion of a semiconductor substrate between the rough grinding and finish grinding of the rear surface of a semiconductor substrate, there is relatively little chance of chipping the edge portion or breaking the semiconductor substrate during the finish-grinding process, polishing process, cleaning process, or substrate transfer process, after edge grinding. Moreover, the previous rough grinding also reduces thicknesses of the bevel portion and edge portion of the semiconductor substrate, so the grinding machining allowance in edge grinding decreases; and a grinding wheel with a diameter of 25-50 mm can be used, so it is possible to design with a reduced (compact) edge grinder footprint (installation area).

In addition, the chamber in which the planarization apparatus is installed is partitioned into three chambers: the front, reverse-L-shaped loading/unloading stage chamber for semiconductor substrates, the middle semiconductor substrate polishing stage chamber, and the rear semiconductor substrate grinding stage chamber. By installing a substrate wet scrubber in the loading/unloading stage chamber and a substrate front-/rear-surface wet scrubber in the semiconductor substrate grinding stage chamber, it is possible to clean to 100 or fewer contaminants (particle size: <0.1 μm) that adhere to the planarized semiconductor substrate.

Because sliding friction is used to polish a semiconductor substrate on a polishing stage abrasive cloth having a diameter greater than that of the semiconductor substrate, it is possible to accelerate polishing. Because there is almost uniform distribution of the pressure applied by the surface of the polishing stage abrasive cloth over the entire surface of the semiconductor substrate, it is possible to obtain a planarized semiconductor substrate with a uniform film thickness distribution. Moreover, when the semiconductor substrate is a through-copper-electrode silicon substrate, it is possible to obtain a TSV wafer whose copper electrode heads (height: 1-20 μm) protrude above the silicon substrate surface, in accordance with the polishing machining allowance (i.e., amount of silicon substrate removed by polishing).

The semiconductor substrate polishing process is a rate-limiting process that typically requires about twice as much time as does the grinding process. Therefore, a CMP polishing apparatus equipped with a pair of substrate adsorption chucks, and which is capable of simultaneously polishing two substrates, was adopted, thereby enabling adjustment to a throughput capable of simultaneously polishing the two ground substrates obtained by grinding, by using the aforementioned polishing stage.

One example of the invention provides a semiconductor substrate planarization apparatus including a chamber in which a planarization apparatus is partitioned, in order from a front portion, into first, second, and third chambers, the first chamber being an L-shaped semiconductor substrate loading/unloading stage chamber, the second chamber being a middle semiconductor substrate polishing stage chamber, and the third chamber being a rear-portion semiconductor substrate grinding stage chamber.

This example further provides an opening portion that opens to an adjacent-stage chamber and enables the insertion and extraction of a substrate being disposed in a partition between each of the stage chambers; and a plurality of load ports provided outside a front wall of the loading/unloading stage chamber.

In this example, the semiconductor substrate loading/unloading stage chamber includes a first articulated substrate transfer robot behind at least one of the loading ports, a substrate wet scrubber is provided to the left of the first articulated substrate transfer robot, as viewed from a front of the semiconductor substrate planarization apparatus, a first temporary positioning placement table is provided above the substrate wet scrubber, and a second transport-type articulated substrate transfer robot is provided behind the first temporary positioning placement table.

Additionally, the polishing stage chamber includes a polishing unit including four sets of stages with centers on a same first circumference, the four sets of stages in the polishing chamber including a temporary placement table stage on which four sets of circular temporary placement tables large enough to accommodate four substrates are provided on a same second circumference and with equal spacing, and three sets of planar and circular first, second, and third polishing stages that each simultaneously polish two substrates, a polishing unit installed in free rotation, with equal spacing, and three sets of dressers that dress a polishing stage abrasive cloth on the side of each of the three sets of polishing stages.

One index head is provided above the four sets of stages, and below the index head is provided a polishing stage such that a substrate chuck unit that absorbs and immobilizes eight substrates, on which substrate chuck are provided, in a concentric circle, four sets of substrate adsorption chuck mechanisms that use a main shaft to support, simultaneously, independently, and in free rotation, a pair of substrate adsorption chucks that adsorb the substrates with the surfaces of substrates to be polished facing downward, enabling an opposition arrangement of each semiconductor substrate adsorbed onto each substrate adsorption chuck in accordance with each of the four sets of stages.

In the semiconductor substrate grinding stage chamber, a second temporary positioning placement table is provided behind the second transport-type articulated substrate transfer robot, a hand arm two-sided rotary-type third articulated transfer robot is disposed to the right of the second temporary positioning placement table, a substrate front-/rear-surface wet scrubber is disposed to the right of the third articulated transfer robot, behind the third articulated transfer robot and the substrate front-/rear-surface wet scrubber is provided a substrate chuck stage in which four sets of substrate chuck tables are provided, on same third circumference, with equal spacing, and in free rotation, on one indexed turntable.

Positions of the loading/unloading stage chuck, substrate rough-grinding stage chuck, substrate edge grinding stage chuck, and substrate finish-grinding chuck of the four sets of substrate chuck tables are indexed and stored in a numerical control device, an edge grinder that than allows an edge grinding wheel to move back and forth and to move up and down is disposed beside the substrate edge grinding stage chuck, a cup wheel-type rough-grinding wheel is provided above the substrate rough-grinding stage chuck, so as to allow vertical translation and rotation, a cup wheel-type finish-grinding wheel is disposed above the substrate finish-grinding stage chuck, so as to allow vertical translation and rotation; and a provided grinding stage chamber performs operations.

The third articulated transfer robot transports the semiconductor substrate on the second temporary positioning placement table onto the loading/unloading stage chuck, transports the semiconductor substrate on the loading/unloading stage chuck onto the substrate front-/rear-surface wet scrubber, and transports the semiconductor substrate on the substrate front-/rear-surface wet scrubber onto the temporary placement table stage in the polishing stage chamber.

DETAILED DESCRIPTION

Figure 1:
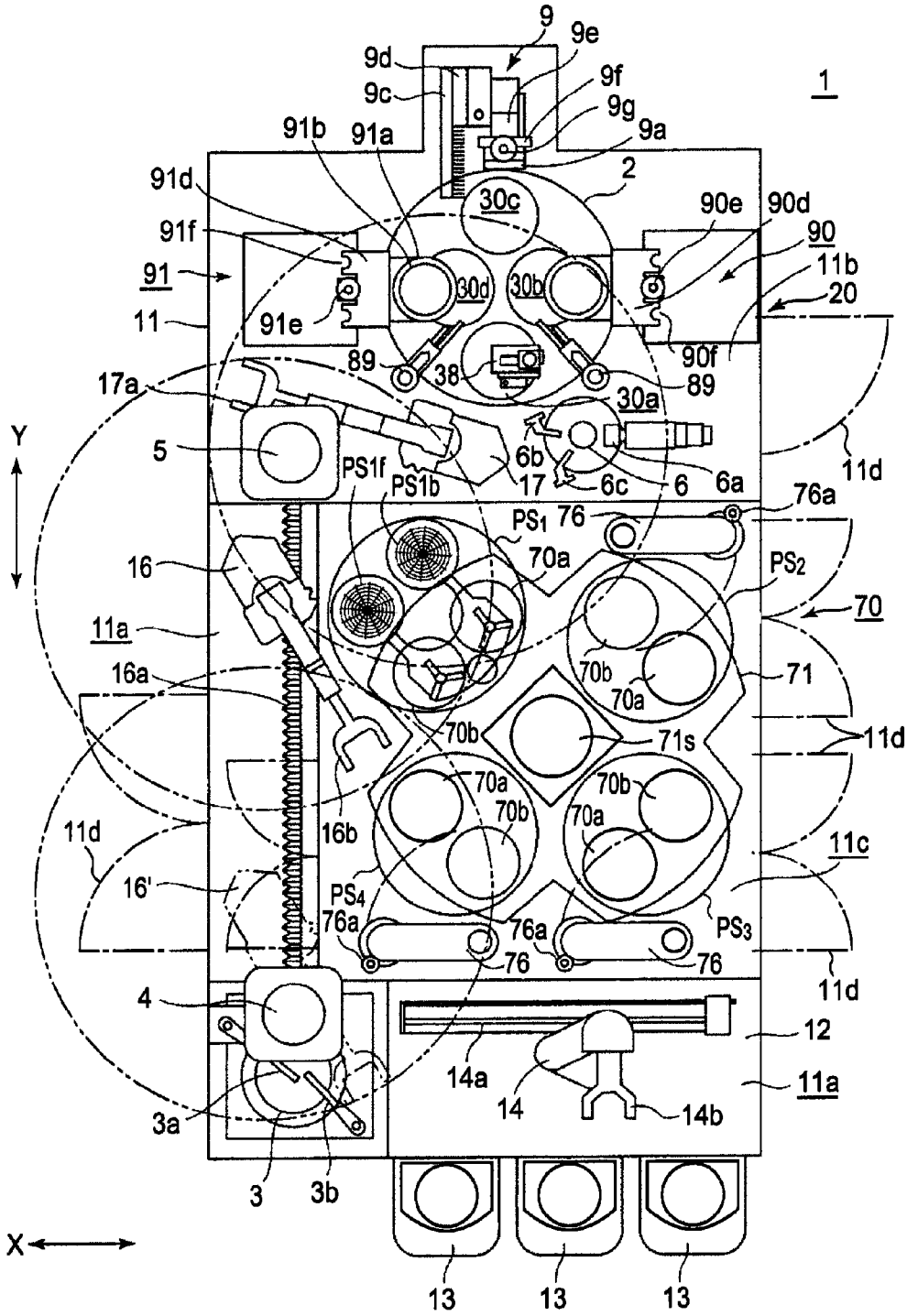
FIG. 1 is a plan view of the semiconductor substrate edge grinding process.

Next, the drawings will be used to describe examples of the present invention in further detail. Chamber 11 of the semiconductor substrate rear-surface planarization apparatus 1 shown in FIG. 1 is partitioned into three chambers: a front, L-shaped semiconductor substrate loading/unloading stage chamber 11*a*, a middle semiconductor substrate polishing stage chamber 11*c*, and a rear semiconductor substrate grinding stage chamber 11*b*. An opening portion that opens to adjacent-stage chambers (11*a*, 11*c* or 11*c*, 11*b*) and enables the insertion and extraction of a substrate is provided in the partition between each of the stage chambers. A plurality of substrate storage cassettes 13, 13, 13 are provided outside the front wall chamber of the aforementioned loading/unloading stage chamber 11*a*. A load port part of the opening portion is also provided in the section contacting the back of the aforementioned substrate storage cassette at the front wall of the chamber; and a door that opens and closes this load port portion is provided. Counter-rotating transparent windows 11*d*, 11*d*, 11*d*, 11*d*, 11*d*, 11*d*, 11*d* are provided in each chamber, for viewing the status of the apparatus of each chamber 11*a*, 11*b*, 11*c*. The rotation path is indicated by the arc of a phantom line in FIG. 1. Moreover, the installed non-contact three-dimensional roughness gauge (inspector) made by AFM Corp. is capable of checking for the presence of semiconductor substrate in the aforementioned substrate storage cassettes 13, 13, 13.

During semiconductor substrate planarization, the chamber pressure of said polishing stage chamber 11*c* is set higher than the chamber pressure of said grinding stage chamber 11*b*.

In the aforementioned semiconductor substrate loading/unloading stage chamber 11*a* is provided a first transfer-type articulated substrate transfer robot 14, on base 12 within the chamber behind the aforementioned load port. A substrate wet scrubber 3 is provided to the left thereof, and a first temporary positioning placement table 4 (see FIG. 1) is provided above the substrate wet scrubber. A second transport-type articulated substrate transfer robot 16 is provided in the back, behind the first temporary positioning placement table (centering device). As shown in FIG. 1, this second transport-type articulated substrate transfer robot 16 can be moved forward and backward by a ball screw 16*a* between the transport-type articulated substrate transfer robot 16 indicated by a solid line and the transport-type articulated substrate transfer robot 16' indicated by a phantom line.

The aforementioned first transport-type articulated substrate transfer robot 14 can be moved in the left and right directions (i.e., the x-axis direction) along guide rail 14*a*. A semiconductor substrate within the aforementioned substrate storage cassette 13 is grasped by a robot hand 14*b*, and is transported onto the aforementioned first temporary positioning placement table 4 (i.e., loaded). The semiconductor substrate on the aforementioned substrate wet scrubber 3 is grasped by the robot hand 14*b*, and is transported to and stored within the substrate storage cassette 13 (i.e., unloaded). The second transport-type articulated substrate transfer robot 16 is capable of transporting in the forward and backward directions (i.e., the y-axis direction) by using a ball screw drive 16*a*. This first transport-type articulated substrate transfer robot 14 may be an articulated substrate transfer robot 14 whose arm hand extension/retraction distance is sufficient for substrate transfer.

Said first temporary positioning placement table 4 is a positioning device that performs semiconductor substrate centering (center-positioning).

The aforementioned substrate wet scrubber 3 is a spin-type substrate wet scrubber that cleans the polished silicon substrate surface of a semiconductor substrate. From one cleaning solution supply nozzle 3*a*, pure water is supplied to the surface of the aforementioned silicon substrate, and from the other cleaning solution supply nozzle 3*b*, a chemical cleaning solution is supplied thereto. Cleaning solution supply nozzles 3*a*, 3*b* are typically swingable.

Distilled water, deep-layer seawater, de-ionized exchange water, surfactant-containing pure water, etc., are used as the pure water. The used chemical cleaning solutions typically include a hydrogen peroxide solution, ozone water, an aqueous solution of hydrofluoric acid, an SC1 solution, a mixed solution of SC1 solution and ozone water, a mixed solution of hydrofluoric acid, hydrogen peroxide solution, and water-soluble amine compound, etc.; or one prepared by blending therein any one of a water-soluble anionic or nonionic, cationic or betaine-type amphoteric solution.

The wet scrubber described in the specification of Japanese Published Unexamined Application No. 2010-23119 (Patent Application No. 2008-183398) may be used as the aforementioned substrate wet scrubber 3. This chemical wet scrubber 3 is equipped with a spin chuck within the cleaning tank, and this spin chuck places and hold the semiconductor substrate w and rotates it in the horizontal direction. The spin chuck is borne on a hollow rotary shaft; a pure-water feed pipe is provided within the hollow rotary shaft; and pure water is used to clean the protective tape surface. A vacuum fluid path is provided inside the hollow rotary shaft and outside the pure water feed pipe. On the upper part of the aforementioned spin chuck, an alkali cleaning solution supply nozzle 3*b* is provided on a support rod that is erected by a rotary drive mechanism, so that the arm causes pendulum rotary motion on the track that passes through the spin chuck center. Also, an acidic cleaning solution supply nozzle 3*b* is provided on a support rod that is erected by a rotary drive mechanism, so that the arm causes pendulum rotary motion on the track that passes through the spin chuck center. In addition, from above the base, a rinse solution supply nozzle is provided at an angle such that the rinse solution reaches the spin chuck center.

Ammonia water (SC1), trimethyl ammonia water, etc., are used as the alkali cleaning solution, to remove contaminants that adhere to the surface of a silicon substrate. Moreover, ozone-dissolved water, hydrogen peroxide water, an aqueous solution of hydrofluoric acid, a mixed aqueous solution of hydrofluoric acid, hydrogen peroxide, and isopropanol, a mixed solution of hydrogen peroxide, hydrochloric acid, and pure water (SC2), etc., are used as the acidic cleaning solution, which plays a role in returning the oxidized silicon substrate surface ($SiO_2$) to silicon (Si).

Pure water such as de-ionized exchange water, distilled water, deep-layer seawater, etc., is used as the rinse solution. The rinse solution typically plays a role in washing away residual alkali and acid from the surface of the semiconductor substrate. Regarding the cleaning of the silicon substrate surface of the semiconductor substrate, alkali cleaning is performed first, acid cleaning is performed second, and rinsing is performed third. A rinse is sometimes added between the first alkali cleaning and the second acid cleaning, as required.

When performing planarization, grinding, and CMP polishing to obtain a 10-80-μm thickness by using the planarization apparatus 1 to reduce by 720-770 μm the thickness of the silicon substrate surface of a semiconductor substrate (DRAM) with a monolayer silicon substrate, the printed wiring plane of the semiconductor substrate is protected with UV-cured acrylic resin adhesive tape, or storage in the storage cassette 13 is performed after using wax or a thermolytic foaming adhesive to adhere the printed wiring plane of the semiconductor substrate to a template such as a glass disk, polycarbonate disk, polymethyl methacrylate disk, a disk made of polyether ester ketone (PEEK), etc. The TSV wafer and the SOI wafer are typically sufficiently thick and they are highly rigid, so the aforementioned protective tape and protective disks need not be used.

The second transport-type articulated substrate transfer robot 16 uses an arm 16*b* to grasp the semiconductor substrate centered on the aforementioned first temporary positioning placement table 4, and to transport the semiconductor substrate onto a second temporary positioning placement table 5 installed in the aforementioned grinding stage chamber 11*b*. The second transport-type articulated substrate transfer robot 16 uses an arm 16*b* to grasp the semiconductor substrate on the substrate front-/rear-surface wet scrubber 6 in the grinding stage chamber 11*b*, and to transport it onto the temporary placement table 70*a*1 in front of the circular temporary placement table stage 70*a* in the aforementioned polishing stage chamber 11*c*. The virtual circle 16*c* indicates the maximum area within which the arm 16*b* of the second transport-type articulated substrate transfer robot can move.

The grinding of the semiconductor substrate on the grinding stage 20 typically takes longer than the loading/unloading of the semiconductor substrate. In the aforementioned grinding stage chamber 11*b* for the semiconductor substrates, the second temporary positioning placement table 5 is provided behind the aforementioned second transport-type articulated substrate transfer robot 16. To the right of this second temporary positioning placement table, a hand arm two-sided rotational-type third articulated transfer robot 17 is provided. The aforementioned substrate front-/rear-surface wet scrubber 6 is provided to the right of this third articulated transfer robot 17. Behind the aforementioned third articulated transfer robot and the substrate front-/rear-surface wet scrubber 6 is provided a substrate chuck stage in which four sets of substrate chuck tables 30*a*, 30*b*, 30*c*, 30*d* are rotatably provided on the same circumference, with even spacing. The fact the aforementioned four sets of substrate chuck tables are at the positions of the loading/unloading stage chuck 30*a*, substrate rough-grinding stage chuck 30*b*, substrate edge grinding stage chuck 30*c*, and substrate finish-grinding chuck 30*d*, clockwise from the front, is stored as the index positions in the process program stored in the memory (not shown) of a numerical control device. The function of the aforementioned third articulated transfer robot 17 is to transport the semiconductor substrate on the aforementioned second temporary positioning placement table 5 onto the aforementioned loading/unloading stage chuck 30*a*, to transport the semiconductor substrate on the aforementioned loading/unloading stage chuck 30*a* to the aforementioned substrate front-/rear-surface wet scrubber 6, and to transport the semiconductor substrate on the aforementioned substrate front-/rear-surface wet scrubber 6 onto the temporary placement table stages PS1*f*, PS1*b* in the aforementioned polishing stage chamber 11*c*.

The aforementioned indexed turntable 2 is borne by the rotary shaft, and this rotary shaft is rotated by a rotational driver (not shown), counter-clockwise in increments of 90°, or clockwise 270°, once every four rotations, for the purpose of preventing torsion damage to the utility pipes for power, coolant, air, etc. As a result of the rotation of this indexed turntable 2, for the four pairs of substrate chuck table 30*a*, 30*b*, 30*c*, 30*d*, the modified chuck names are recorded in the recording portion (not shown) for numerical control, as the locations of differently named substrate chuck tables 30*b*, 30*c*, 30*d*, 30*a*.

The chuck washer 38 disclosed in U.S. Pat. No. 7,238,087 Specification (Patent Document 3) may be provided on the aforementioned loading/unloading stage chuck 30*a*. This chuck washer 38 comprises a brush 38*a*, a rotary chuck cleaner grinding wheel 38*b*, and a pure-water supply nozzle. While the pure-water supply nozzle supplies pure water on the surface of the aforementioned rotating loading/unloading stage chuck 30*a*, the rotating brush 38*a* is lowered, makes contact, and slides with friction, thereby removing grinding residue adhering to the surface of the 30*a*. The brush is raised, then the rotating rotary chuck cleaner grinding wheel 38*b* is lowered, contacts the surface of chuck 30*a*, and slides with friction, thereby removing the pure water supplied by the pure-water supply nozzle and the grinding residue sticking out of the porous ceramic chuck 30*a*. Furthermore, pressurized water is sprayed out of the rear of the aforementioned porous ceramic chuck 30*a*, thereby typically completely spraying away the grinding residue sticking out of the porous ceramic chuck 30*a*, from inside the porous ceramic chuck 30*a*.

A rough grinding unit 90 is typically provided, and enables vertical ascending/descending movement, driven by a motor 90*e* on a guide rail 90*f*, of a sliding plate 90*d* provided, in front of a column, with a fixing plate 90*c* that immobilizes the grinding wheel shaft 90*b* that bears the diamond cup wheel-type rough grinding wheel 90*a* (abrasive number: 300-2,000), above the aforementioned substrate rough-grinding stage chuck 30*b*. The motor that drives rotation of the aforementioned grinding wheel shaft 90*b* and the rotary drive apparatus (e.g., pulley, transmission belt) are not shown because they are provided within the column. The rotation speed of the substrate chuck is typically 8-300 rpm ($min^{-1}$). The rotation speed of the cup wheel-type grinder is 1,000-4,000 $min^{-1}$, and the amount of grinding fluid supplied to the silicon substrate surface is typically 100-2,000 cc/min.

Grinding fluid is supplied by the grinding fluid supply nozzle (not shown) at the grinding point, where the semiconductor substrate contacts the aforementioned diamond cup wheel-type rough grinding wheel 90*a*. Usable grinding fluids include pure water, an aqueous dispersion of ceria particles, an aqueous dispersion of fumed silica, an aqueous dispersion of colloidal silica, or a blend of tetramethylammonium, ethanolamine, caustic potash, imidazolium salt, etc., in these grinding fluids.

On the base 12 beside the aforementioned substrate edge grinding stage chuck 30*c* is provided an edge grinder 9 such that the edge grinding wheel 9*a* is moved back and forth on the guide rail 9*c* and the slider 9*d* can move back and forth, driven by the motor 9*e*. The sliding plate that immobilizes the grinding wheel shaft bearing the aforementioned edge grinding wheel 9*a* can typically ascend/descend vertically on the guide plate 9*f*, driven by the motor 9*g*.

Figure 2:
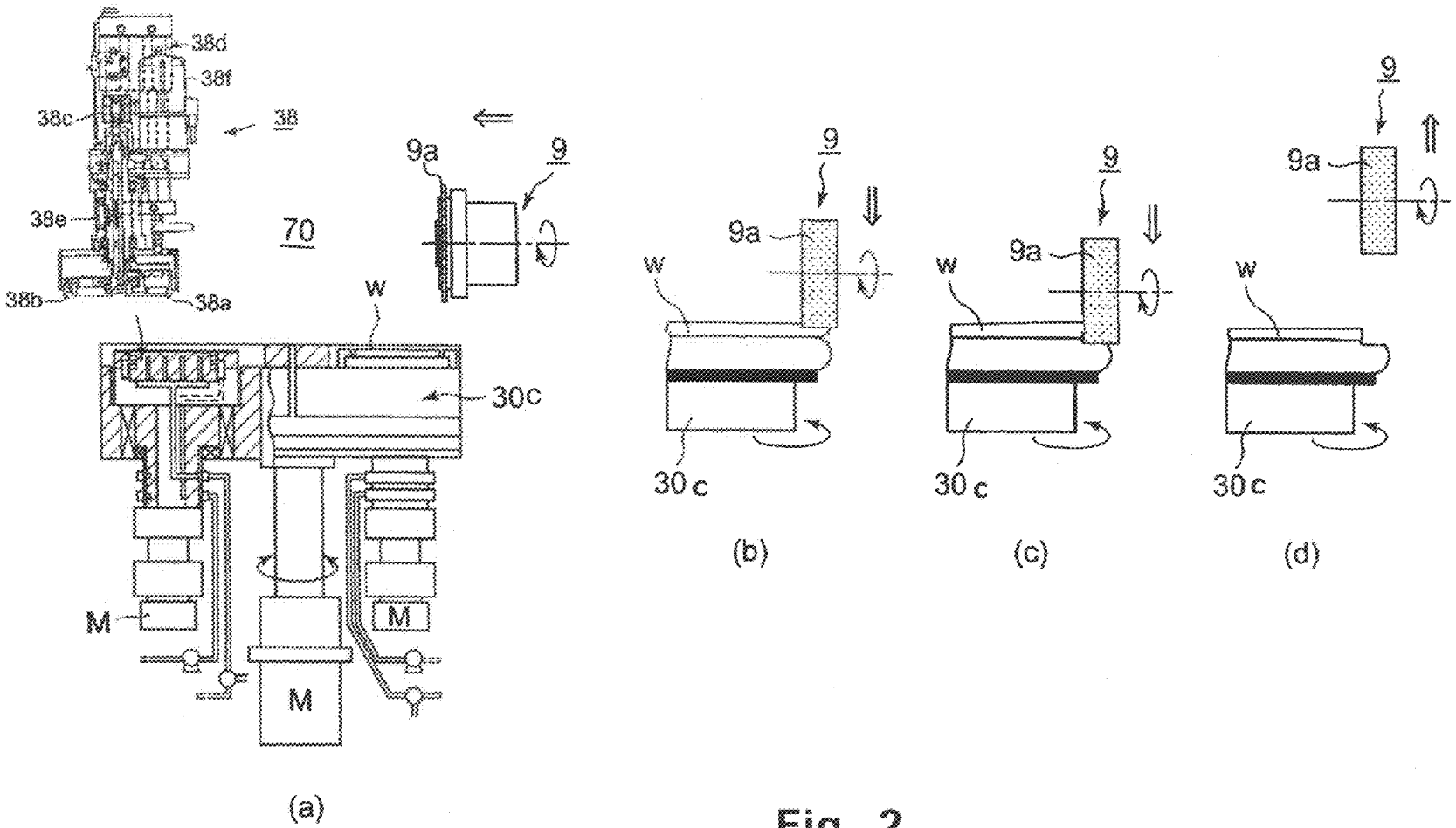
FIG. 2 is a plan view of a semiconductor substrate planarization apparatus.

As shown in FIGS. 2(*a*)-(*d*), to edge-grind the silicon substrate periphery of the semiconductor substrate w that was rough-ground by using the aforementioned edge grinder 9, the aforementioned edge grinding wheel 9*a* is moved forward while rotating above the silicon substrate periphery of the semiconductor substrate w on the rotating substrate edge grinding stage chuck 30*c* (FIG. 2*a*). Then the aforementioned edge grinding wheel 9*a* is lowered; and the circumferential surface of the edge grinding wheel 9*a* contacts and slides with friction on 0.5-3 mm of the silicon substrate periphery. Infeed grinding is performed (FIG. 2*b*). After reduction by the desired thickness, the aforementioned edge grinding wheel 9*a* is raised and moved away from the edge-grinding surface of the semiconductor substrate w.

As the grinding fluid supplied at the grinding point, where the silicon substrate periphery of the semiconductor substrate contacts the aforementioned edge grinder 9*a*, usable grinding fluids typically include pure water, an aqueous dispersion of ceria particles, an aqueous dispersion of fumed silica, an aqueous dispersion of colloidal silica, or a blend of tetramethylammonium, ethanolamine, caustic potash, imidazolium salt, etc., in these grinding fluids.

Figure 4:
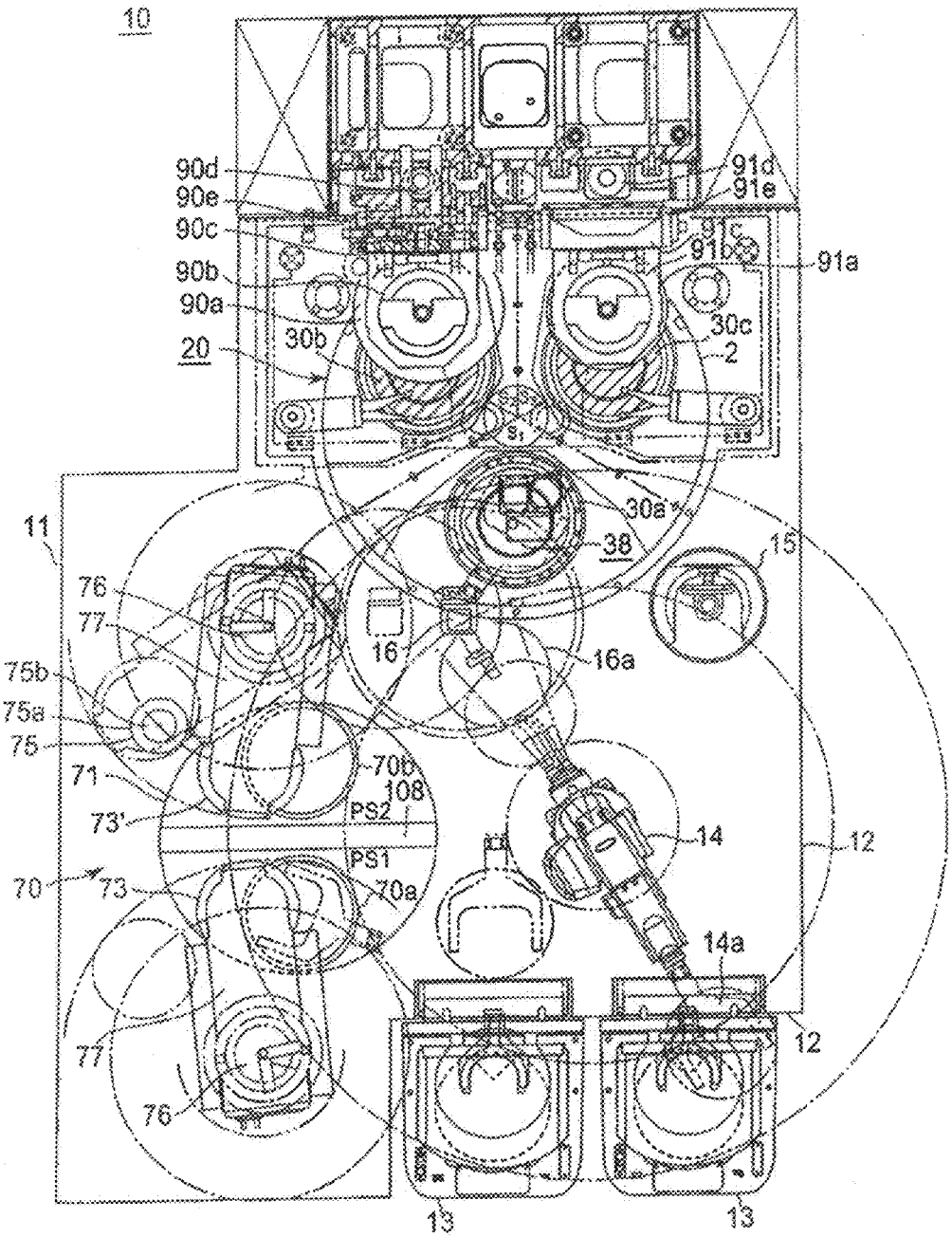
FIG. 4 is a plan view of a conventional semiconductor substrate planarization apparatus.

As shown in FIGS. 1 and 4, a finish grinding unit 91 is provided and enables vertical ascending/descending movement, driven by a motor 91*e* on a guide rail 91*f*, of a sliding plate 91*d*. The sliding plate 91*d* is disposed in front of a column, with a fixing plate 91*c* that immobilizes the grinding wheel shaft 91*b* that bears the diamond cup wheel-type rough finish-grinding wheel 91*a* (abrasive number: 2,500-30,000), above the aforementioned substrate finish-grinding stage chuck 30*d*. The motor that drives rotation of the aforementioned grinding wheel shaft 91*b* and the rotary drive apparatus (e.g., pulley, transmission belt) are not shown, because they are provided within the column. The rotation speed of the substrate chuck is typically 5-80 rpm ($min^{--1}$); the rotation speed of the cup wheel-type grinder is typically 400-3,000 $min^{-1}$, and the amount of grinding fluid supplied to the silicon substrate surface is typically 100-2,000 cc/min.

The grinding machining allowance (thickness: 730-750 μm) of the silicon substrate surface, which has a thickness of about 750-770 μm at grinding stage 20, is removed, and a 10-40 μm thickness is removed at the finish-grinding stage.

Two-point-type thickness indicators 89, 89, (see FIG. 1) which measure the thickness of the semiconductor substrate, are provided on the base 12 beside the substrate rough-grinding stage chuck 30*b* and the substrate finish-grinding chuck 30*d*. The thickness gauge that measures the thickness of this semiconductor substrate may be a non-contact thickness gauge equipped with a data analysis means, a control unit, a sensor head holder having a fluid path capable of supplying a gas at the periphery of a sensor head equipped with the laser beam photoemitter and photoreceiver disclosed in Unexamined Application Publication No. 2009-88073.

Available thickness gauges that utilize the reflectance of such a commercial laser beam are silicon substrate thickness gauges that use near-infrared light (wavelength: 1.3 μm) to irradiate one side of a silicon substrate on a measurement stage, with a laser beam spot diameter of 1.2-250 μmψ; then use a photoreceiver to detect the reflected light thereof; and then calculate the thickness of the silicon substrate. Product names are the LTM1001 of Precise Gauges Co., the C8125 thickness gauge of PhotoGenic Corp., and the FSM413-300 of Frontier Semiconductor Inc. (U.S.). In addition, regarding non-contact optical thickness gauges that utilize reflectance spectroscopy that uses near-infrared light with a wavelength of 650-1,700 nm and a beam spot diameter of 100-1,000 μmψ, available products are the F20-XT non-contact optical thickness gauge of Filmetrics Inc. (U.S.) and the MCPD5000 inline film thickness gauge of Otsuka Electronics Co., Ltd. White light (wavelength: 420-720 nm) is used as the wavelength of the spectroscopy that measures the thickness of the printed-wiring substrate surface of the semiconductor substrate, and the 650-nm or 1.3-μm wavelength is used as the wavelength of the spectroscopy that measures the thickness of the silicon substrate.

The aforementioned hand arm two-sided rotational-type third articulated transfer robot 17 uses the hand arm 17*a* to grasp the semiconductor substrate on the loading/unloading stage chuck 30*a*, and transfers it onto the aforementioned substrate front-/rear-surface wet scrubber 6.

The aforementioned substrate front-/rear-surface wet scrubber 6 is equipped with, for example, a pair of brushes 6*a*, 6*a* that brush scrub clean the outer periphery of the front and rear surfaces of the semiconductor substrate, and cleaning solution supply nozzles 6*b*, 6*c* that supply cleaning solution to the front and rear surfaces of the semiconductor substrate. The front and rear surfaces of the semiconductor substrate are cleaned by transporting the semiconductor substrate onto the disk-shaped porous ceramic adsorption chuck 6*d* of the substrate front-/rear-surface wet scrubber 6; next, while cleaning solution is supplied to the front and rear surfaces of the placed semiconductor substrate, and while the disk-shaped porous ceramic adsorption chuck 6*d* is spun, brush scrub cleaning is performed. Then, the periphery of the semiconductor substrate is grasped with six pairs of locking catches, and the ring supporting these locking catches is raised with equal spacing, thereby moving the semiconductor substrate away from the upper surface of the disk-shaped porous ceramic adsorption chuck 6*d*, after which the cleaning solution is supplied to the front and rear surfaces of the semiconductor substrate, from the aforementioned cleaning solution supply nozzles 6*b*, 6*c*. Also, as the substrate front-/rear-surface wet scrubber 6 disclosed in the back of Published Unexamined Application No. 2009-277740, a concrete instance is a substrate front-/rear-surface wet scrubber 6 such that a cleaning solution storage tank is provided at the center of the wet scrubber. A support flange is provided around the rotary spindle standing at the center of the storage tank. A planetary rotary shaft is provided so as to stand in parallel with the aforementioned rotary spindle from this support flange. A substrate surface-wiping tool with a diameter equal to the distance from the periphery of the semiconductor substrate to the center is provided at the top of the planetary rotary shaft. By rotationally driving the aforementioned rotary spindle, this substrate surface-wiping tool is subjected to planetary rotation, thereby subjecting to planetary rotational cleaning the surface from the outer periphery of the semiconductor substrate to the center.

Pure water is usually used as the rough-grinding fluid, finish-grinding fluid, and cleaning solution. In subsequent processes, however, the semiconductor substrate is supplied to polishing or cleaning, so the pure eater may also contain an alkali or water-soluble amine compound.

The semiconductor substrate, whose front and rear surfaces on the substrate front-/rear-surface wet scrubber 6, is grasped by arm 17*a* of the aforementioned third transport-type articulated-type substrate transfer robot 17 and transported onto the temporary placement table stages PS1*f*, PS1*b* of the circular temporary placement table stage PS1 in the aforementioned polishing stage chamber 11*c*.

Polishing of the semiconductor substrate in the aforementioned polishing stage chamber 11*c* typically requires about twice the time of the grinding operation at the aforementioned grinding stage 20. Therefore, it is configured so that the polishing stage 70 can simultaneously polish two semiconductor substrates.

In the aforementioned polishing stage chamber 11*c* are provided: a polishing system that comprises a temporary placement table stage PS1 on which are provided four sets of circular temporary placement tables capable of accommodating four substrates on the same circumference and with equal spacing, and three (i.e., first, second, third) polishing stages PS2, PS3, PS4 of the planar circular polishing stages on which two substrates are polished simultaneously. The centers of these four sets of stages PS1, PS2, PS3, PS4 are typically on the same circumference, where they are equally spaced and rotate freely. Three sets of dressers 76, 76, 76 that dress the abrasive cloth of the polishing stage, beside the aforementioned three sets of polishing stage PS2, PS3, PS4, respectively, are also provided. Dresser cleaning nozzles 76*a*, 76*a*, 76*a* are provided beside the dresser supports. The polishing stage 70 is configured such that one index head 71 is provided above these four sets of stages PS1, PS2, PS3, PS4, and stage 70 is provided with a substrate chuck capable of adsorbing and immobilizing eight substrates. Also provided, in concentric circles, are four sets of substrate adsorption chuck mechanisms that use the main shaft to simultaneously, independently, and in free rotation support a pair of substrate adsorption chucks 70*a*, 70*b* that adsorb a substrate with the polished surface facing downward, below this index head.

Figure 3:
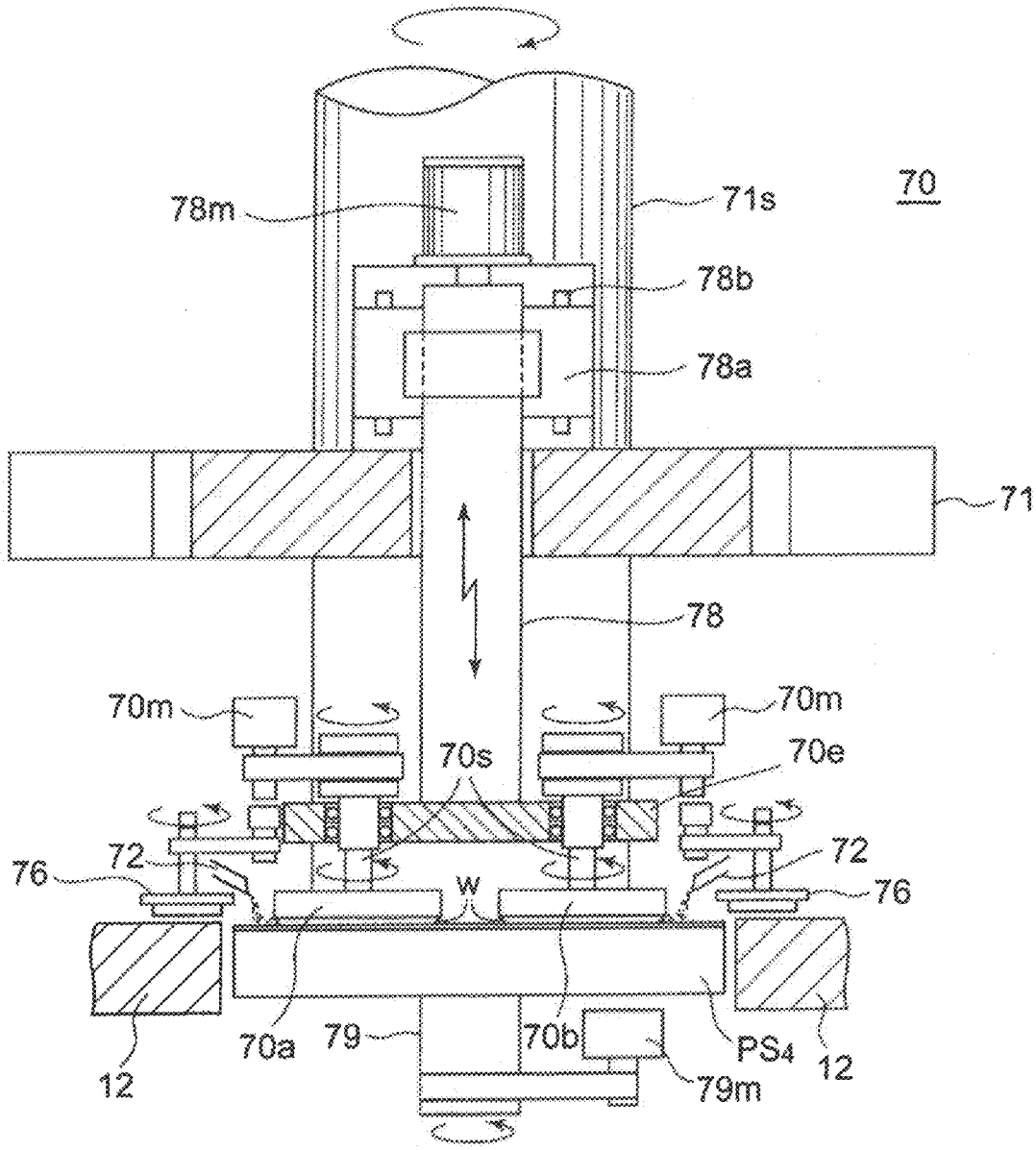
FIG. 3 is a diagram showing a cross-sectional view of the state in which two semiconductor substrates are polished on the third polishing stage.

As shown in FIG. 3, for the pair of the aforementioned substrate adsorption chucks 70*a*, 70*b*, 90° rotation of the rotary shaft 71*s* of the index head 71 enables each of the substrate adsorption chucks 70*a*, 70*b* to face any of the aforementioned four stages PS1, PS2, PS3, PS4.

In addition, the spindle shafts 70*s*, 70*s* of the pair of aforementioned substrate adsorption chucks 70*a*, 70*b* are independently rotatable by driving with motors 70*m*, 70*m*. The top of support plate 70*e*, which supports the fixing plates of both substrate adsorption chuck 70*a*, 70*b* is suspended by the shaft 78; in a provided immobilizing, screw-movable table, a ball screw screws into the rear surface of a sliding plate 78*a* that immobilizes this shaft 78; and the rotary drive of servomotor 78*m* is transmitted to the aforementioned ball screw, thereby enabling sliding up and down guide rail 78*b*. This up-and-down movement enables up-and-down movement of the pair of aforementioned substrate adsorption chucks 70*a*, 70*b*.

The rotary shaft 79 of the aforementioned four sets of stages PS1, PS2, PS3, PS4 is rotated by servomotor 79*m*.

Polishing is performed, in which the silicon substrate surfaces of two (first and second) semiconductor substrates w, w adsorbed onto a pair of the aforementioned substrate adsorption chucks 70*a*, 70*b*, whose spindle shafts 70*s*, 70*s* are rotating, contact and slide with friction against the surface of the abrasive cloth PS of the polishing stage, in which rotary shaft 79 is rotating.

During polishing of the aforementioned semiconductor substrates, an aqueous polish agent is supplied from supply nozzles 72, 72, at the processing point when the aforementioned semiconductor substrates w, w and the polishing stage abrasive cloth PS slide with friction. At least the following such aqueous polishing agents are usable: pure water, an aqueous dispersion of ceria particles, an aqueous dispersion fumed silica, an aqueous dispersion of colloidal silica, or a base such as tetramethylammonium hydroxide, ethanolamine, caustic potash, imidazolium salt, etc., a surfactant, a chelating agent, a pH-adjuster, an oxidizer, or a preservative blended with these grinding fluids. The aqueous polishing agent is typically supplied to an abrasive cloth (polishing pad) at the rate of 50-2,500 cc/min.

The preferable abrasive cloth of polishing stages PS2, PS3, PS4 is one such that a foaming polyurethane laminate sheet and a nonwoven cloth are coated and saturated with a coating agent composed of a hardening compound having an active hydrogen group and a urethane polymer, and this is subjected to thermal foaming. Purchasable abrasive cloths are a polyurethane laminated sheet pad made by Nitta Haas Inc. and Toyobo Co., Ltd., a polyester fiber nonwoven cloth pad made by Toray Coatex Co., Ltd., and Mitsui Chemicals Inc., and a ceria-containing polyurethane pad made by Toyobo Co., Ltd. The preferable polishing cloth for the electrode feeding of a TSV wafer is a soft, foaming polyurethane pad with a JIS-A hardness of 60-85.

Although not indicated in FIG. 1, the preferable thickness gauge for measuring the thickness of a polished semiconductor substrate is the non-contact thickness gauge disclosed in the aforementioned Published Unexamined Application No. 2009-88073.

The rotation speed of the pair of aforementioned substrate adsorption chucks 70*a*, 70*b*, whose aforementioned spindle shafts 70*s*, 70*s* are rotating, is typically 5-100 $min.^{-1}$ on polishing stages PS2, PS3, and is 2-55 $min.^{-1}$ on polishing stage PS4. The preferable rotation speed of polishing stages PS2, PS3 is 5-100 $min.^{-1}$, and the preferable rotation speed of polishing stage PS4 is 2-55 $min^{-1}$. The pressure applied by a polishing stage on the semiconductor substrate is 50-300 $g/cm^2$, preferably 80-250 $g/cm^2$. The polishing conditions during rough polishing and medium-finish polishing and the type of aqueous polishing agent may be identical or different.

85% to 95% of the polishing machining allowance (thickness: 5-20 μm) of the semiconductor substrate at polishing stage 70 is removed at the rough polishing stage and the medium-finish polishing stage of the aforementioned semiconductor substrate, and a thickness of 0.1-2 μm is removed during finish polishing. A polishing agent slurry containing ceria particles or silica particles in an aqueous polishing agent, polishes the silicon substrate surface before the metal electrodes, which yields a TSV substrate with a 1-20 μm electrode head projection height above the silicon substrate surface.

When an abrasive cloth with uniform surface properties is used, the electrode head projection height of the obtained TSV wafer is a projection height that is 90% to 95% of the polishing machining allowance at locations where electrodes exists in isolation, and is a projection height that is 55% to 60% of the polishing machining allowance at locations where electrodes are dense. Therefore, in the event of the use of an abrasive cloth with a pattern such that the JIS-A hardness of the abrasive cloth that polishes locations where electrodes are densely present is lower than the JIS-A hardness of an abrasive cloth that polishes location where electrodes are present in isolation, it is expected to be possible to obtain a TSV wafer in which the two electrode projection height are more similar than when only one hardness of abrasive cloth is used.

The following process is used to thin and planarize the silicon substrate surface of the rear surface of a semiconductor substrate or the through-electrode silicon substrate surface of the rear surface of a TSV substrate, by using the substrate planarization apparatus 1 shown in FIG. 1. Furthermore, the operation time in parentheses depends also on the diameter of the semiconductor substrate and the machining allowance (thickness) for the thinned silicon substrate. However, the typical operation times for the processing of semiconductor substrates with diameters of 300 mm and 450 mm are listed.

1) The first articulated substrate transfer robot 14 is used to transfer and move semiconductor substrate w stored in substrate storage cassette 13 into loading/unloading stage chamber 11*a*, after which it is transported to temporary positioning placement table 4, and the semiconductor substrate is centered on the temporary positioning placement table (3-8 sec.).

2) A second transport-type articulated substrate transfer robot 16 is used to transport the semiconductor substrate of the first temporary positioning placement table 4 to the second temporary positioning placement table 5 in the grinding stage chamber 11*b*. The semiconductor substrate is centered on this second temporary positioning placement table (3-8 sec.).

3) The third articulated transfer robot 17 is used to place the semiconductor substrate of this second temporary positioning placement table 5 on the loading/unloading stage chuck 30*a* mounted on the indexed turntable 2. Then the chuck 30*a* is evacuated to immobilize, facing upward, the rear surface (silicon substrate surface) of the semiconductor substrate on the adsorption chuck 30*a* (3-8 sec.).

4) The aforementioned indexed turntable 2 is rotated 90° in the counterclockwise direction, to move the semiconductor substrate on the aforementioned loading/unloading stage chuck 30*a* to the position of the substrate rough grinding stage chuck 30*b* (0.5-2 sec.).

5) Substrate rough grinding stage chuck 30*b* is rotated at a rotation speed of 8-300 $min^{-1}$. Next, while rotating the cup wheel-type rough grinding wheel 90*a* at a rotation speed of 1,000-4,000 $min^{-1}$, it is lowered to contact and slide with friction against the silicon substrate surface of the semiconductor substrate. Meanwhile, in-field rough-grinding is performed. The reduction thickness is, for example, 730 μm. During in-field rough grinding, grinding fluid is supplied at the rate of 100-2,000 cc/min, at the operation point when the semiconductor substrate w contacts the aforementioned cup wheel-type rough grinding wheel 90*a*. When the thickness of the aforementioned semiconductor substrate, which was measured with thickness gauge 89, reaches the desired thickness threshold, the aforementioned cup wheel-type rough grinding wheel 90*a* is raised and moved away from the silicon substrate surface of the aforementioned semiconductor substrate (2.5-5 min.).

6) The aforementioned indexed turntable 2 is rotated 90° in the counter-clockwise direction, and the roughly ground semiconductor substrate on the aforementioned substrate rough grinding stage chuck 30*b* is moved to the position of the substrate edge grinding stage chuck 30*c* (0.5-2 sec.).

7) While the substrate edge grinding stage chuck 30*c* is rotated at a rotation speed of 50-300 $min^{-1}$ and edge grinding wheel 9*a* of the edge grinder is rotated at a rotation speed of 1,000-8,000 $min^{-1}$, they are moved forward to the semiconductor substrate. Next, this rotating edge grinding wheel 9*a* is lowered to perform in-field edge grinding that reduces, to the desired thickness (20-100 μm), the periphery of the silicon substrate on the rear surface of the semiconductor substrate rear surface on the substrate edge grinding stage chuck 30*c*. Grinding fluid is supplied at the operation point when the aforementioned semiconductor substrate w contacts edge grinding wheel 9*a*. When the thickness of the outer periphery of the aforementioned semiconductor substrate, which was measured by using a thickness gauge (not shown), reaches the desired thickness threshold, the aforementioned edge grinding wheel 9*a* is raised and moved away from the outer periphery surface of the aforementioned semiconductor substrate. Then the aforementioned edge grinding wheel 9*a* is retracted, returning to the edge-grinding starting point (0.5-1 min.).

8) The aforementioned indexed turntable 2 is rotated 90° in the counterclockwise direction, and the semiconductor substrate, which was subjected to edge-grinding on the aforementioned substrate edge-grinding stage chuck 30*c*, is moved to the location of the substrate finish-grinding stage chuck 30*d* (0.5-2 sec.).

9) The substrate finish-grinding stage chuck 30*d* is rotated at a rotation speed of 8-300 $min^{-1}$. The cup wheel-type finish-grinding wheel 91*a* is lowered while being rotated at a rotational speed of 400-3,000 $min^{-1}$. In-feed finish-grinding is performed while contacting the silicon substrate surface of the roughly ground semiconductor substrate. The reduced thickness is 1-20 μm, preferably 2-10 μm. During the in-feed finish-grinding process, a grinding solution is supplied at the work point of contact between the aforementioned cup wheel-type finish-grinding wheel and the semiconductor substrate. When the thickness of the aforementioned semiconductor substrate, which was measured with a thickness gauge 89, reaches the desired thickness threshold, the aforementioned cup wheel-type finish-grinding wheel 91*a* is raised and moved away from the silicon substrate surface of the aforementioned semiconductor substrate (2-4 min.).

10) The aforementioned indexed turntable 2 is rotated either 270° in the clockwise direction or 90° in the counterclockwise direction, and the semiconductor substrate on the aforementioned substrate finish-grinding stage chuck 30*d* is moved to the location of the loading/unloading stage chuck 30*a* (0.5-2 sec.).

11) The semiconductor substrate, which was immobilized on the aforementioned loading/unloading stage chuck 30*a* and was subjected to rough-grinding, edge-grinding, and finish-grinding, is transported to the substrate front-/rear-surface wet scrubber 6 by using the third articulated transfer robot 17, where the front and rear surfaces of the aforementioned semiconductor substrate are cleaned (5-15 sec.).

12) The aforementioned third articulated transfer robot 17 is used to transport the semiconductor substrate w on the substrate front-/rear-surface wet scrubber 6, onto the temporary placement table stage PS1*f* in the aforementioned polish stage chamber 11*c*. The front and rear are reversed so that the silicon substrate surface of the semiconductor substrate faces downward, and is placed on the aforementioned temporary placement table stage PS1 (1-2 sec.).

13) The transfer arm of the aforementioned third articulated transfer robot returns to the standby position (0.5-1 sec.).

14) During aforementioned processes 1) through 13), a different, newly transported second semiconductor substrate is subjected to rough-grinding, edge-grinding, finish-grinding, and both-side cleaning. The aforementioned third articulated transfer robot 17 is used to transport the semiconductor substrate w on the aforementioned substrate front-/rear-surface wet scrubber 6, onto the temporary placement table stage PS1 in the aforementioned polish stage chamber 11*c*. The front and rear are reversed so that the silicon substrate surface of the semiconductor substrate faces downward, and is placed on the aforementioned temporary placement table stage PS1*b* (2-4 sec.).

15) The rotary shaft 79 of the temporary placement table stage PS1 on which were placed the aforementioned two semiconductor substrates w, w is rotated 180°. Next, the pair of substrate adsorption chucks 70*a*, 70*b*, which are provided from above this temporary placement table stage PS1 to below the index head 71, are lowered, and the aforementioned first and second semiconductor substrates w, w are vacuum-adsorbed, after which this pair of substrate adsorption chucks 70*a*, 70*b* are raised (2-4 sec.).

16) The main shaft of the index head is rotated 90° in the clockwise direction, and a pair of substrate adsorption chucks, which hold the bottoms of the aforementioned two semiconductor substrates, move to the position opposing the first polishing stage PS2 (1-2.5 sec.).

17) While the first polishing stage PS2 is rotated at a speed of 5-100 $min^{-1}$, the aforementioned pair of substrate adsorption chucks 70*a*, 70*b* are lowered while being rotated at a speed of 5-100 $min^{-1}$, and the silicon substrate surfaces of the aforementioned two semiconductor substrates w, w are rough-polished by subjecting them to sliding friction on an abrasive cloth of the aforementioned first polishing stage PS2. During this rough polishing, abrasive solution is supplied from polishing solution supply nozzles 72, 72, at the point during polishing when there is sliding friction between the abrasive cloth of the first polishing stage and the silicon substrate surface of the semiconductor substrate. After the silicon substrate surface of the semiconductor substrate is rough-polished to the desired thickness reduction (e.g., 10 μm), the aforementioned pair of substrate adsorption chucks are raised, and rotation of the pair of adsorption chucks 70*a*, 70*b* is stopped (5-10 min.).

18) The main shaft 71*s* of the index head is rotated 90° in the clockwise direction, and the pair of substrate adsorption chucks 70*a*, 70*b*, which hold the bottoms of the aforementioned two semiconductor substrates w, w that were polished to a rough finish, move to the position opposing the second polishing stage PS3 (1-2.5 sec.).

19) While the second polishing stage PS3 is rotated at a speed of 5-100 $min^{-1}$, the aforementioned pair of substrate adsorption chucks 70*a*, 70*b* are lowered while being rotated at a speed of 5-100 $min^{-1}$, and the silicon substrate surfaces of the aforementioned two semiconductor substrates w, w are subjected to medium-fine polishing by using sliding friction on an abrasive cloth of the aforementioned second polishing stage PS3. During this medium-finish polishing, abrasive solution is supplied from polishing solution supply nozzles 72, 72, at the point during polishing when there is sliding friction between the abrasive cloth of the second polishing stage and the silicon substrate surface of the semiconductor substrate. After the silicon substrate surface of the semiconductor substrate is subjected to medium-fine polishing to the desired thickness reduction (e.g., 5 μm), the aforementioned pair of substrate adsorption chucks are raised, and rotation of the pair of adsorption chucks 70*a*, 70*b* is stopped (5-10 min.).

20) The main shaft 71*s* of the index head is rotated 90° in the clockwise direction, and a pair of substrate adsorption chucks 70*a*, 70*b*, which hold the lower surface of the aforementioned two semiconductor substrates w, w that were polished to a medium finish, move to the position opposing the third polishing stage PS4 (1-2.5 sec.).

21) While the third polishing stage PS4 is rotated at a speed of 2-55 $min^{-1}$, the aforementioned pair of substrate adsorption chucks 70*a*, 70*b* are lowered while being rotated at a speed of 2-55 $min^{-1}$, and the silicon substrate surfaces of the aforementioned two semiconductor substrates are subjected to fine-finish polishing by using sliding friction on an abrasive cloth of the aforementioned third polishing stage PS4. During this fine-finish polishing, abrasive solution is supplied from polishing solution supply nozzles 72, 72, at the point during polishing when there is sliding friction between the abrasive cloth of the third polishing stage and the silicon substrate surface of the semiconductor substrate. After the silicon substrate surface of the semiconductor substrate is subjected to fine-finish polishing to the desired thickness reduction (e.g., 1-2 μm), the aforementioned pair of substrate adsorption chucks 70*a*, 70*b* are stopped, and rotation of the aforementioned third polishing stage PS4 also is stopped (2-8 min.).

22) The main shaft 71*s* of the index head is rotated 90° clockwise or 270° counter-clockwise [−270°], and the pair of substrate adsorption chucks 70*a*, 70*b*, which hold the lower surface of the aforementioned two finish-polished semiconductor substrates w, w, are moved to the location opposing the temporary placement table stage PS1, the two semiconductor substrates adsorbed onto the pair of substrate adsorption chucks 70*a*, 70*b* are made to contact the surface of the temporary placement table stage PS1. Then by injecting pressurized air for 0.5-1 sec. from the rear of the aforementioned pair of aforementioned substrate adsorption chucks 70*a*, 70*b*, the pair of substrate adsorption chucks 70*a*, 70*b* of the semiconductor substrate are raised, thereby leaving behind, on the aforementioned temporary placement table stage PS1, two semiconductor substrates polished to a fine finish. Then the aforementioned temporary placement table stage PS1 is rotated 180° (2-4 sec.).

23) The aforementioned second transport-type articulated substrate transfer robot 16 within the loading/unloading stage chamber 11*a* is used to grasp the first semiconductor substrate w, which is a semiconductor substrate that is polished to a fine finish and placed on the aforementioned temporary placement table stage PS1 in the aforementioned polish stage chamber 11*c* and which is positioned at PS1*f* facing the aforementioned second transport-type articulated substrate transfer robot 16. Then this first semiconductor substrate, which was polished to a fine finish, is transported to the substrate wet scrubber 3, where the semiconductor polished to a fine finish is spin-washed (0.5-2 min.).

24) First transport-type articulated substrate transfer robot 14 is used to grasp the cleaned first semiconductor substrate w on the aforementioned substrate wet scrubber 3, and transport and store it in the load port-positioned storage cassette 13. Meanwhile, the aforementioned second transport-type articulated substrate transfer robot 16 is used to grasp the second semiconductor substrate w, which was polished to a fine finish, on the aforementioned temporary placement table stage PS 1*b*. Next, this second semiconductor substrate w, which was polished to a fine finish, is transported onto the aforementioned substrate wet scrubber 3, where the semiconductor substrate polished to a fine finish is subjected to spin-cleaning. (0.5-2 min.)

25) A first transport-type articulated substrate transfer robot 14 is used to grasp the second semiconductor substrate w cleaned on the aforementioned substrate wet scrubber 3, which is transported to and stored within the storage cassette 13 at the load port position. (1-3 sec.)

While the aforementioned processes 1) through 25) are being performed, the mechanical elements in each substrate loading/substrate unloading stage chamber 11*a*, grinding stage chamber 11*b*, and polishing stage chamber are subjected to a substrate loading/substrate unloading stage operation, a grinding stage operation, and a polishing stage operation like those aforementioned.

Consequently, it is possible to obtain a maximum of about 24 planarized semiconductor substrates per hour, because the maximum throughput time is about 5 min. for the surface planarization of two semiconductor substrates subjected to: 740-μm-thick grinding reduction of the silicon substrate on the rear surface of a semiconductor substrate subjected to wiring printing on the surface of a silicon substrate with a diameter of 300 mm and a thickness of 770 μm, and 10-μm-thick polishing reduction. In addition, it is possible to obtain about 12 planarized semiconductor substrates per hour, because the maximum throughput time is about 11 min. for the surface planarization of a pair of semiconductor substrates subjected to: 730-μm-thick grinding reduction of the silicon substrate on the rear surface of a semiconductor substrate subjected to wiring printing on the surface of a silicon substrate with a diameter of 450 mm and a thickness of 770 μm, and 10-μm-thick polishing reduction.

Furthermore, the throughput time for the planarization of the copper electrode head projections of a pair of TSV wafers with two laminated through-electrode wafers (diameter: 300 mm; thickness: 775 μm) is about 10 min., so it is possible to obtain 12 copper electrode head projection TSV wafers per hour.

Embodiment 1

The substrate planarization apparatus shown in FIG. 1 was used to planarize the copper electrode head projections of the copper through-silicon substrate (TSV wafer; thickness: 1,550 μm) of a TSV wafer formed by laminating the through-electrode wafers of two substrates with a 300-mm diameter and a 775-μm thickness, under the processing conditions listed below. Table 1 lists the height distribution (unit: μm) of the copper electrode head projections in the electrode isolated part and the electrode dense part of a TSV wafer. During the planarization of the copper electrode head projections of 26 TSV wafers, no TSV wafer chipping or breakage was observed.

Process Conditions:

Rough-grinding process machining allowance: 700-μm thickness

Edge grinding machining allowance: 2 mm wide and 50 μm thick, from peripheral edge to center Finish-grinding process machining allowance: 33-μm thickness Rough-polishing process and medium-finish polishing process machining allowance: 10-μm thickness Finish-polishing process machining allowance: 12-μm thickness Process rate-limiting stage and throughput time thereof:

5 min. 48 sec. for both rough-polishing stage and medium-finish polishing stage

Grinding fluid: ion-exchanged water (pure)

Abrasive fluid used in rough-polishing process, medium-finish polishing process, and finish-polishing process: Fujimi Inc.'s colloidal silica-type abrasive slurry "Glanzox-1302 (trade name)"

Substrate front-/rear-surface cleaning solution: ion-exchanged water

Cleaning solution used in first washer: 1st time, SC1; 2nd time, SC2; finally, ion-exchanged water Abrasive number of diamond cup wheel-type rough-grinding wheel: no. 500

Rotation speed of rough-grinding wheel shaft: 2400 $min^{-1}$

Abrasive number of diamond vitrified bonded edge grinding wheel: no. 500

Rotation speed of rough-grinding process stage adsorption chuck: 200 $min^{-1}$

Abrasive number of diamond cup wheel-type finish-grinding wheel finish-grinding wheel: no. 8000

Rotation speed of finish-grinding wheel shaft: 1700 $min^{-1}$

Rotation speed of finish-grinding process stage adsorption chuck: 200 $min.^{-1}$ Abrasive cloth for each polishing stage: Nitta Haas Incorporated-made SUBA 1400 (trade name)

Rotation speed of substrate chuck during rough-polishing process, medium-finish polishing process: 41 $min.^{-1}$ Rotation speed of second and third polishing stages during rough-polishing process and medium-finish polishing process: 40 $min.^{-1}$ Rotation speed of substrate chuck during finish-polishing process: 21 $min^{-1}$

Embodiments 2 and 3

The copper electrode head projections of a through-copper-electrode silicon substrate (TSV wafer) were planarized as in Embodiment 1, except that the machining allowance of the TSV silicon substrate surface was performed under the processing conditions listed in Table 1. The distribution of the obtained heights (μm) of the copper electrode head projections of the TSV wafers is listed in Table 1.

TABLE 1

| Embodiment | Grinding Machining Allowance (μm) | Polishing Machining Allowance (μm) | Throughput | Electrode Isolated Part Edge | Electrode Isolated Part Center | Electrode Dense Part Edge | Electrode Dense Part Center |
|---|---|---|---|---|---|---|---|
| 1 | 733 | 12 | 5 min. 46 sec. | 10.61 | 11.80 | 5.33 | 5.62 |
| 2 | 740 | 20 | 9 min. 52 sec. | 18.73 | 19.37 | 10.56 | 11.48 |
| 3 | 755 | 7 | 4 min. 39 sec. | 5.26 | 6.55 | 3.49 | 3.83 |

Embodiment 4

The substrate planarization apparatus shown in FIG. 1 was used to planarize the rear-surface silicon substrate of a DRAM substrate formed by adhering an adhesive protective sheet to the printed wiring plane of the semiconductor substrate (diameter: 300 mm, thickness: 775 μm), a silicon substrate, under the processing conditions listed below. The average surface roughness Ra of the DRAM having an obtained silicon substrate thickness of 25 μm was 0.5 nm.

Furthermore, the average roughnesses of the ground silicon substrate surface after grinding is completed and it is moved to the polishing stage are a 4-nm Ra, 0.024-μm Ry, and 0.016-μm Rz.

No DRAM chipping or breakage was observed during planarization of the rear surface of 26 DRAMs. The throughput time per DRAM was 4 min. 42 sec.

Process Conditions:

Rough-grinding process machining allowance: 540-μm thickness

Edge grinding machining allowance: 2 mm wide and 210 μm thick, from peripheral edge to center Finish-grinding process machining allowance: 200-μm thickness Rough-polishing process and medium-finish polishing process machining allowance: 8-μm thickness Finish-polishing process machining allowance: 2-μm thickness Process rate-limiting stage and throughput time thereof:

4 min. 40 sec. for both rough-polishing stage and medium-finish polishing stage

Grinding fluid: ion-exchanged water (pure)

Abrasive fluid used in rough-polishing process, medium-finish polishing process, and finish-polishing process: Fujimi Inc.'s colloidal silica-type abrasive slurry "Glanzox-1302 (trade name)"

Substrate front-/rear-surface cleaning solution: ion-exchanged water

Cleaning solution used in first washer: 1st time, SC1; 2nd time, SC2; finally, ion-exchanged water Abrasive number of diamond cup wheel-type rough-grinding wheel: no. 500

Rotation speed of rough-grinding wheel shaft: 2400 $min^{-1}$

Rotation speed of rough-grinding process stage adsorption chuck: 200 $min^{-1}$

Abrasive number of diamond vitrified bonded edge grinding wheel: no. 500

Abrasive number of diamond cup wheel-type finish-grinding wheel: no. 8000

Rotation speed of finish-grinding wheel shaft: 1700 $min^{-1}$

Rotation speed of finish-grinding process stage adsorption chuck: 200 $min.^{-1}$ Abrasive cloth of each polishing stage: Nitta Haas Inc.-made SUBA 1400 (trade name)

Rotation speed of substrate chuck during rough-polishing process and medium-finish polishing process: 41 $min.^{-1}$ Rotation speed of second and third polishing stages during rough-polishing process and medium-finish polishing process: 40 $min.^{-1}$ Rotation speed of substrate chuck during finish-polishing process: 21 $min^{-1}$ The semiconductor substrate planarization apparatus of the above-described examples of the present invention are capable of grinding and polishing, with high throughput, the silicon substrate surface of a semiconductor substrate rear surface. In addition, the examples enable the fabrication of an extremely thin semiconductor substrate with relatively few adhered contaminants.

The invention claimed is:

1. A semiconductor substrate planarization apparatus comprising:

a chamber in which a planarization apparatus is partitioned, in order from a front portion, into first, second, and third chambers, the first chamber being an L-shaped semiconductor substrate loading/unloading stage chamber, the second chamber being a middle semiconductor substrate polishing stage chamber, and the third chamber being a rear-portion semiconductor substrate grinding stage chamber;

an opening portion that opens to an adjacent-stage chamber and enables the insertion and extraction of a substrate being disposed in a partition between each of the stage chambers; and a plurality of load ports provided outside a front wall of the loading/unloading stage chamber, wherein the semiconductor substrate loading/unloading stage chamber includes a first articulated substrate transfer robot behind at least one of the loading ports, a substrate wet scrubber is provided to the left of the first articulated substrate transfer robot, as viewed from a front of the semiconductor substrate planarization apparatus, a first temporary positioning placement table is provided above the substrate wet scrubber, and a second transport-type articulated substrate transfer robot is provided behind the first temporary positioning placement table, wherein the polishing stage chamber includes a polishing unit including four sets of stages with centers on a same first circumference, the four sets of stages in the polishing chamber including a temporary placement table stage on which four sets of circular temporary placement tables large enough to accommodate four substrates are provided on a same second circumference and with equal spacing, and three sets of planar and circular first, second, and third polishing stages that each simultaneously polish two substrates, a polishing unit installed in free rotation, with equal spacing, and three sets of dressers that dress a polishing stage abrasive cloth on the side of each of the three sets of polishing stages, wherein one index head is provided above the four sets of stages, and below the index head is provided a polishing stage such that a substrate chuck unit that absorbs and immobilizes eight substrates, on which substrate chuck are provided, in a concentric circle, four sets of substrate adsorption chuck mechanisms that use a main shaft to support, simultaneously, independently, and in free rotation, a pair of substrate adsorption chucks that adsorb the substrates with the surfaces of substrates to be polished facing downward, enabling an opposition arrangement of each semiconductor substrate adsorbed onto each substrate adsorption chuck in accordance with each of the four sets of stages, wherein, in the semiconductor substrate grinding stage chamber, a second temporary positioning placement table is provided behind the second transport-type articulated substrate transfer robot, a hand arm two-sided rotary-type third articulated transfer robot is disposed to the right of the second temporary positioning placement table, a substrate front-/rear-surface wet scrubber is disposed to the right of the third articulated transfer robot, behind the third articulated transfer robot and the substrate front-/rear-surface wet scrubber is provided a substrate chuck stage in which four sets of substrate chuck tables are provided, on same third circumference, with equal spacing, and in free rotation, on one indexed turntable, wherein positions of the loading/unloading stage chuck, substrate rough-grinding stage chuck, substrate edge grinding stage chuck, and substrate finish-grinding chuck of the four sets of substrate chuck tables are indexed and stored in a numerical control device, an edge grinder that than allows an edge grinding wheel to move back and forth and to move up and down is disposed beside the substrate edge grinding stage chuck, a cup wheel-type rough-grinding wheel is provided above the substrate rough-grinding stage chuck, so as to allow vertical translation and rotation, a cup wheel-type finish-grinding wheel is disposed above the substrate finish-grinding stage chuck, so as to allow vertical translation and rotation, and a provided grinding stage chamber performs operations, and wherein the third articulated transfer robot transports the semiconductor substrate on the second temporary positioning placement table onto the loading/unloading stage chuck, transports the semiconductor substrate on the loading/unloading stage chuck onto the substrate front-/rear-surface wet scrubber, and transports the semiconductor substrate on the substrate front-/rear-surface wet scrubber onto the temporary placement table stage in the polishing stage chamber.

2. The apparatus of claim 1, further comprising substrate storage cassettes received in the plurality of load ports provided outside the front wall of the loading chamber.

3. The apparatus of claim 1, wherein the edge grinder is disposed farther from the front wall of the apparatus than are disposed the four sets of substrate chuck tables.

4. The apparatus of claim 1, wherein the semiconductor substrate loading/unloading stage chamber includes a first linear actuator and a second linear actuator.

5. The apparatus of claim 4, wherein the first linear actuator is disposed such that a direction of actuation of the first linear actuator is perpendicular to a direction of actuation of the second linear actuator.

6. The apparatus of claim 5, wherein the first articulated substrate transfer robot is disposed on the first linear actuator, and the second articulated substrate transfer robot is disposed on the second linear actuator.

7. The apparatus of claim 6, wherein the first linear actuator is disposed with a direction of actuation parallel to the front wall.

8. The apparatus of claim 1, wherein the plurality of load ports provided outside a front wall of the loading/unloading stage chamber includes three loading ports.

9. The apparatus of claim 1, wherein the wet scrubber is disposed in the corner of the L-shaped semiconductor substrate loading/unloading stage chamber.

10. A method of planarizing the rear surface of a semiconductor substrate, the method comprising:

providing a semiconductor substrate planarization apparatus including a chamber in which a planarization apparatus is partitioned, in order from a front portion, into first, second, and third chambers, the first chamber being an L-shaped semiconductor substrate loading/unloading stage chamber, the second chamber being a middle semiconductor substrate polishing stage chamber, and the third chamber being a rear-portion semiconductor substrate grinding stage chamber;

an opening portion that opens to an adjacent-stage chamber and enables the insertion and extraction of a substrate being disposed in a partition between each of the stage chambers; and a plurality of load ports provided outside a front wall of the loading/unloading stage chamber, wherein the semiconductor substrate loading/unloading stage chamber includes a first articulated substrate transfer robot behind at least one of the loading ports, a substrate wet scrubber is provided to the left of the first articulated substrate transfer robot, as viewed from a front of the semiconductor substrate planarization apparatus, a first temporary positioning placement table is provided above the substrate wet scrubber, and a second transport-type articulated substrate transfer robot is provided behind the first temporary positioning placement table, wherein the polishing stage chamber includes a polishing unit including four sets of stages with centers on a same first circumference, the four sets of stages in the polishing chamber including a temporary placement table stage on which four sets of circular temporary placement tables large enough to accommodate four substrates are provided on a same second circumference and with equal spacing, and three sets of planar and circular first, second, and third polishing stages that each simultaneously polish two substrates, a polishing unit installed in free rotation, with equal spacing, and three sets of dressers that dress a polishing stage abrasive cloth on the side of each of the three sets of polishing stages, wherein one index head is provided above the four sets of stages, and below the index head is provided a polishing stage such that a substrate chuck unit that absorbs and immobilizes eight substrates, on which substrate chuck are provided, in a concentric circle, four sets of substrate adsorption chuck mechanisms that use a main shaft to support, simultaneously, independently, and in free rotation, a pair of substrate adsorption chucks that adsorb the substrates with the surfaces of substrates to be polished facing downward, enabling an opposition arrangement of each semiconductor substrate adsorbed onto each substrate adsorption chuck in accordance with each of the four sets of stages, wherein, in the semiconductor substrate grinding stage chamber, a second temporary positioning placement table is provided behind the second transport-type articulated substrate transfer robot, a hand arm two-sided rotary-type third articulated transfer robot is disposed to the right of the second temporary positioning placement table, a substrate front-/rear-surface wet scrubber is disposed to the right of the third articulated transfer robot, behind the third articulated transfer robot and the substrate front-/rear-surface wet scrubber is provided a substrate chuck stage in which four sets of substrate chuck tables are provided, on same third circumference, with equal spacing, and in free rotation, on one indexed turntable, wherein positions of the loading/unloading stage chuck, substrate rough-grinding stage chuck, substrate edge grinding stage chuck, and substrate finish-grinding chuck of the four sets of substrate chuck tables are indexed and stored in a numerical control device, an edge grinder that than allows an edge grinding wheel to move back and forth and to move up and down is disposed beside the substrate edge grinding stage chuck, a cup wheel-type rough-grinding wheel is provided above the substrate rough-grinding stage chuck, so as to allow vertical translation and rotation, a cup wheel-type finish-grinding wheel is disposed above the substrate finish-grinding stage chuck, so as to allow vertical translation and rotation, and a provided grinding stage chamber performs operations, and wherein the third articulated transfer robot transports the semiconductor substrate on the second temporary positioning placement table onto the loading/unloading stage chuck, transports the semiconductor substrate on the loading/unloading stage chuck onto the substrate front-/rear-surface wet scrubber, and transports the semiconductor substrate on the substrate front-/rear-surface wet scrubber onto the temporary placement table stage in the polishing stage chamber, wherein the semiconductor substrate planarization apparatus transports the semiconductor substrates stored in a substrate storage cassette into the grinding stage chamber, wherein in the grinding stage chamber, a cup wheel grinder roughly grinds the rear surface of a semiconductor substrate, a width of 1 to 3 mm is removed from the rear surface peripheral edge of the roughly ground semiconductor substrate, by edge-grinding with a grinding wheel, after which the rear surface of the semiconductor substrate is thinned by using a cup wheel grinder for finish-grinding, wherein the thinned semiconductor substrate is transported to a polishing stage chamber, and wherein, in the polishing stage chamber, the rear surface of the semiconductor substrate is planarized by performing rough-polishing, medium-finish polishing, and finish-polishing, which subject to sliding friction, at the polishing stage, the rear surfaces of the two thinned semiconductor substrates held by a pair of adsorption chucks.

11. The method according to claim 10, wherein from 85% to 95% of the thickness of material to be removed from the substrate during polishing is removed during rough-polishing and medium-finish polishing.

12. The method according to claim 11, wherein the thickness of material to be removed is from 5 to 20 μm.

13. The method according to claim 11, wherein 0.1 to 2.0 μm is removed during finish-polishing.

14. The method according to claim 10, wherein at least one of an aqueous dispersion of ceria particles, an aqueous dispersion fumed silica, an aqueous dispersion of colloidal silica, tetramethylammonium hydroxide, ethanolamine, caustic potash, imidazolium salt, a surfactant, a chelating agent, a pH-adjuster, or an oxidizer is applied to the thinned semiconductor substrate during finish polishing.

15. The method according to claim 10, further comprising leaving an electrode projection extending above the semiconductor substrate after finish-polishing.

16. The method according to claim 10, further comprising applying an abrasive cloth of a first hardness in a first location on the semiconductor substrate where electrodes are present in a first density and applying an abrasive cloth of a second hardness in a second location where electrodes are present in a second density different from the first density.

* * * * *